United States Patent [19]

McGarry et al.

[11] Patent Number: 4,605,420

[45] Date of Patent: Aug. 12, 1986

[54] METHOD FOR THE BENEFICIATION OF OXIDIZED COAL

[75] Inventors: Phillip E. McGarry, Palmerton; David E. Herman, Jim Thorpe; Robert A. Treskot, Walnutport; David C. Fistner, Sr., Bethlehem, all of Pa.

[73] Assignee: Sohio Alternate Energy Development Company, Cleveland, Ohio

[21] Appl. No.: 627,163

[22] Filed: Jul. 2, 1984

[51] Int. Cl.[4] ..... C10L 9/02; C10L 1/32

[52] U.S. Cl. ..... 44/1 R; 44/1 SR; 44/51; 44/68

[58] Field of Search ..... 44/1 R, 1 SR, 51, 68

[56] References Cited

U.S. PATENT DOCUMENTS

| | | | |
|---|---|---|---|
| 3,617,095 | 11/1971 | Lissant | 44/51 |
| 3,762,887 | 10/1973 | Clancey et al. | 44/51 |
| 4,033,852 | 7/1977 | Horowitz et al. | 44/1 R |
| 4,217,109 | 8/1980 | Siwersson et al. | 44/1 SR |
| 4,304,573 | 12/1981 | Burgess et al. | 44/51 |
| 4,332,593 | 6/1982 | Burgess et al. | 44/51 |
| 4,347,126 | 8/1982 | McGarry et al. | 210/706 |
| 4,347,127 | 8/1982 | Duttera et al. | 210/706 |
| 4,391,608 | 7/1983 | Dondelewski | 44/1 SR |
| 4,406,664 | 9/1983 | Burgess et al. | 44/1 R |
| 4,412,842 | 11/1983 | Klayer | 44/1 SR |
| 4,412,843 | 11/1983 | Burgess et al. | 44/1 R |
| 4,436,618 | 3/1984 | Rigby et al. | 44/1 SR |
| 4,465,495 | 8/1984 | Scheffee | 44/51 |
| 4,475,924 | 10/1984 | Meyer | 44/1 SR |

FOREIGN PATENT DOCUMENTS

| | | | |
|---|---|---|---|
| 0105237 | 4/1984 | European Pat. Off. | 44/1 R |
| 146264 | 6/1921 | United Kingdom | 44/1 R |
| 1523193 | 8/1978 | United Kingdom | 44/1 R |

*Primary Examiner*—Andrew H. Metz
*Assistant Examiner*—Helane Myers
*Attorney, Agent, or Firm*—Bruce E. Harang; David J. Untener; Larry W. Evans

[57] ABSTRACT

A process for modifying the surface of oxidized coal, said process comprising subjecting coal having oxidized surfaces to high shear agitation in water followed by desliming the resultant aqueous coal mixture.

3 Claims, No Drawings

METHOD FOR THE BENEFICIATION OF OXIDIZED COAL

BACKGROUND OF THE INVENTION

This invention relates to a process for the beneficiation of solid carbonaceous fuel materials and more particularly to a process for the beneficiation of oxidized coal.

Known resources of coal and other solid carbonaceous fuel materials are far greater than the known resources of petroleum and natural gas combined. Despite this enormous abundance of coal and related solid carbonaceous materials, reliance on these resources, particularly coal, as primary sources of energy, has been, for the most part, discouraged. The availability of cheaper, cleaner burning, more readily retrievable and transportable fuels, such as petroleum and natural gas, has, in the past, cast coal to a largely supporting role in the energy field.

Current world events, however, have forced a new awareness of global energy requirements and of the availability of those resources which will adequately meet these needs. The realization that reserves of petroleum and natural gas are being rapidly depleted in conjunction with skyrocketing petroleum and natural gas prices and the unrest in the regions of the world which contain the largest quantities of these resources, has sparked a new interest in the utilization of solid carbonaceous materials, particularly coal, as primary energy sources.

As a result, enormous efforts are being extended to make coal and related solid carbonaceous materials equivalent or better sources of energy, than petroleum or natural gas. In the case of coal, for example, much of this effort is directed to overcome the environmental problems associated with its production, transportation and combustion. For example, health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasification and liquefaction processes may be found, for example, in the *Encyclopedia of Chemical Technology,* Kirk-Othmer, Third Edition (1980) Volume 11, pages 410–422 and 449–473. Typically these techniques, however, require high energy input, as well as the utilization of high temperature and high pressure equipment, thereby reducing their widespread feasibility and value.

Processes to make coal more readily liquefiable have also been developed. One such process is disclosed in U.S. Pat. No. 4,033,852 (Horowitz et al.). This process involves chemically modifying the surface of the coal, the effect of which renders a portion of the coal more readily liquefiable than the natural forms of coal.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than solid dry coal, they are more easily storable, and less subject to the risks of explosion by spontaneous ignition. Moreover, providing coal in a fluid form makes it feasible for burning in conventional apparatus used for burning fuel oil. Such a capability can greatly facilitate the transition from fuel oil to coal as a primary energy source. Typically, coal-oil and coal-aqueous mixtures and their preparation are disclosed in U.S. Pat. Nos. 3,762,887, 3,617,095 and 4,217,109 and British Pat. No. 1,523,193.

Regardless of the form in which the coal is ultimately employed, the coal must be cleaned because it contains substantial amounts of sulfur, nitrogen compounds, and mineral matter, including significant quantities of metal impurities. During combustion these materials enter the environment as sulfur dioxides, nitrogen oxides and compounds of metal impurities. If coal is to be accepted as a primary energy source, it must be cleaned to prevent pollution of the environment, either by cleaning the combustion products or the coal prior to burning.

Accordingly, physical, as well as chemical, coal cleaning (beneficiation) processes have been extensively explored. In general, physical coal cleaning processes involve grinding the coal to release the impurities, wherein the fineness of the coal generally governs the degree to which the impurities are released. However, because the costs of preparing the coal rise exponentially with the amount of fines, there is an economic optimum in size reduction. Moreover, grinding coal even to the finest sizes is not effective in removing all impurities.

Based on the physical properties that effect the separation of the coal from the impurities, physical coal cleaning methods are divided into four general categories: gravity, flotation, magnetic and electrical methods.

In contrast to physical coal cleaning, chemical coal cleaning techniques are in a very early stage of development. Known chemical coal cleaning techniques include, for example, oxidative desulfurization of coal (sulfur is converted to a water-soluble form by air oxidation), ferric salt leaching (oxidation of pyritic sulfur with ferric sulfate), and hydrogen peroxide-sulfuric acid leaching. Other methods are disclosed in the above-noted reference to the *Encyclopedia of Chemical Technology,* Volume 6, pages 314–322.

A recent promising development in the art of chemical coal beneficiation is disclosed in U.S. Pat. No. 4,304,573 incorporated herein by reference. In summary, according to this coal beneficiation process, coal is first cleaned of rock and the like and pulverized to a fine size. The pulverized coal, now in the form of a water slurry, is then contacted with a mixture comprising a polymerizable monomer, polymerization catalysts and fuel oil. The resultant surface treated coal is highly hydrophobic and oleophilic and is thus readily separated from unwanted ash and sulfur using oil and water separation techniques. Moreover, the hydrophobic coal can be readily further dehydrated to very low water levels without employing costly thermal energy. The clean, very low moisture content coal, resulting from this process can then be employed as is, i.e., a dry solid product, or used to form advantageous coal-oil or coal-aqueous mixtures.

However, all coal does not respond equivalently to beneficiation procedures. For example, as a result of the varient chemical make-up of the known classes of coal, e.g. lignite, anthracite, bituminous, etc., each class responds differently to beneficiation. The so-called low rank coals, i.e. low rank bituminous, lignite and peat, contain water of hydration, which impairs and at times prevents, beneficiation by conventional froth flotation processes. For example, these coals do not respond satisfactorily to the so-called Otiska process.

Furthermore, coals, in general, upon exposure to air and varying amounts of water, become "oxidized" i.e. have oxidized surfaces. Such oxidized coal is characterized by changes in wettability and floatability as related to recovery by froth flotation procedures. The floatability of coals is gradually decreased by the increase in the extent of oxidation. As a result, the recoveries of beneficiated coal become significantly reduced.

Previous attempts to overcome the detrimental effects of oxidized coal in froth flotation have been essentially of a chemical nature. Most have had only limited success. It is, therefore, highly desirable to provide a process for altering or conditioning the surfaces of oxidized coals in order to achieve higher recoveries of the beneficiated product.

SUMMARY OF THE INVENTION

Accordingly, it is one object of the present invention to provide a process for conditioning coal having oxidized surfaces to improve the response to beneficiation by froth flotation.

It is another object of this invention to provide an improved coal beneficiation process for oxidized coal.

These and other objects are achieved herein by providing a process comprising subjecting coal having oxidized surfaces to high shear agitation in a water medium and then desliming the resultant coal mixture. Other embodiments of the present invention include introducing the resultant coal now having unoxidized surfaces to beneficiation procedures.

DETAILED DESCRIPTION OF THE INVENTION

In accordance with the present invention, the floatability of oxidized coal during froth flotation is improved by the creation of fresh, unoxidized surfaces on the coal by subjecting the coal to hioh shear agitation in water prior to introducing the coal to the froth flotation process. The high shear aqitation of the oxidized coal in water can be accomplished by any suitable means. For example, a preferred means herein is by the utilization of attrition scrubbers which operate at sufficient speeds (r.p.m.) to provide the necessary high shear agitation. While it is not understood fully, it is believed that the high shear agitation of the coal in water causes the coal particles to rub against each other having the effect of scrubbing off the oxidized surfaces (including slime if any) from the coal particles and creating fresh surfaces. By creating fresh surfaces the coal is more susceptible to froth flotation techniques. After the coal has been sufficiently agitated as hereinbefore described, the coal mixture is deslimed. A preferred method of desliming includes the utilization of a hydrocyclone apparatus. Other procedures include, for example, other classifiers such as hydroseparators.

After the coal has been deoxidized in accordance with the process of the present invention as hereinbefore described, it is also within the scope of the present invention to beneficiate the deoxidized coal by froth flotation techniques. A preferred froth flotation beneficiation technique, which when employed and integrated with the de-oxidizing process of this invention results in especially improved recoveries of beneficiated coal, is the process disclosed and claimed in U.S. Pat. No. 4,304,573 (Burgess et al.) the entire contents of which are incorporated herein by reference.

The coal beneficiation process disclosed in said U.S. Pat. No. 4,304,573, in general, involves admixing an aqueous pulverized coal slurry (e.g. as de-oxidized by the process disclosed herein) with a surface treating mixture comprising a polymerizable monomer, a polymerization catalyst and a minor amount of fuel oil.

The coal-aqueous slurry is typically one having a coal to water ratio of about 1:3 parts by weight, respectively. If utilized, water conditioning additives, such as conventional inorganic and organic dispersants, surfactants and/or wetting agents, are employed in small amounts, usually, for example, from about 0.25% to about 5% based on the weight of dry coal. Preferred additives include sodium carbonate, sodium pyrophosphate and the like.

The aqueous coal slurry is admixed with the surface treating admixture under any polymerization conditions, for example, temperatures ranging from about 20° to about 70° C. at atmospheric or nearly atmospheric conditions from about 1 second to about 30 minutes, preferably from about 1 second to about 3 minutes. The resultant surface treated coal is extremely hydrophobic and oleophilic and thus a coal froth phase ensues which is readily removed from the remaining aqueous ash containing phase.

Any polymerizable monomer can be employed in the polymerization reaction medium herein. While it is more convenient to utilize monomers which contain olefinic unsaturation permitting polymerization with the same or different molecules can also be used. Thus, monomers, intended to be employed herein may be characterized by the formula XHC=CHX' wherein X and X' each may be hydrogen or any of wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, vinylbromide, acrylonitrile, acrylamide, methacrylamine, N-methylolacrylamide, acrolein, maleic acid, maleic anhydride, fumaric acid, abietic acid and the like.

A preferred class of monomers for the purposes of the present invention are unsaturated carboxylic acids, esters, or salts thereof, particularly, those included within the formula $$RC(=O)-OR'$$

wherein R is an olefinically unsaturated organic radical, preferably containing from about 2 to about 30 carbon atoms, and R' is hydrogen, a salt-forming cation such as an alkali metal, alkaline earth metal or ammonium cation, or a saturated or ethylenically unsaturated hydrocarbyl radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di-, and triglycerides, and other esters of unsaturated fatty acids, acrylic acid, methacrylic acid, methylacrylate, ethylacrylate, ethylhexylacrylate, tertiarybutyl acrylate, oleylacrylate, methylmethacrylate, oleylmethacrylate, stearylacrylate, stearylmethacrylate, laurylmethacrylate, vinylstearate, vinylmyristate, vinyllaurate, soybean oil, dehydrated castor oil, tall oil, corn oil and the like. For the purposes of this invention, tall oil and corn oil have been found to provide particularly advantageous results. Corn oil is especially preferred. Thus, it is clearly understood that compositions containing compounds within the foregoing formula and in addition containing, for example, saturated fatty acids, such as palmitic, stearic, etc. are also contemplated herein.

The amount of polymerizable monomer will vary depending upon the results desired. In general, however, monomer amounts of from about 0.005% to about 1.0% by weight, preferably from 0.02 to 0.1 percent by weight of the dry coal are used.

The catalysts employed in the coal surface treating beneficiation reaction are any such materials commonly used in polymerization reactions. Typically, for the purposes of this invention, any catalytic amount of those catalysts, which are commonly referred to as free radical catalysts or catalyst system (which can also be referred to as addition polymerization initiators) are preferred. Thus, illustratively, catalysts contemplated herein include benzoyl peroxide, methylethyl ketone peroxide, tertbutyl-hydroperoxide, hydrogen peroxide, ammonium persulfate, di-tert-butylperoxide, tert-butylperbenzoate, peracetic acid and including such non-peroxy free radical initiators as the diazo compounds, such as 1,1'bis-azoisobutyronitrile, and the like.

Moreover, free radical polymerization systems commonly employ free radical initiators which function to help initiate the free radical reaction. For the purposes herein, any of those disclosed in the prior art may be used. Specifically, some of these initiators include, for example, sodium perchlorate and perborate, sodium persulfate, potassium persulfate, ammonium persulfate, silver nitrate, water soluble salts of noble metals such as platinum and gold, water soluble salts of iron, zinc, arsenic, antimony, tin, cadmium and mixtures thereof. Particularly preferred initiators herein are the water soluble copper salts, i.e. cuprous and cupric salts, such as copper acetate, copper sulfate and copper nitrate. Most advantageous results have been obtained herein with cupric nitrate, $Cu(NO_3)_2$. Further initiators contemplated herein are also disclosed in copending U.S. patent application Ser. No. 230,063 filed Jan. 29, 1981 and incorporated herein by reference. These initiators include metal salts of naphthenates, tallates, octanoates, etc., said metals including copper, cobalt, manganese, nickel, tin, lead, zinc, iron, rare earth metals, mixed rare earths and mixtures thereof. The amounts of catalysts contemplated herein include any catalytic amount and generally are within the range of from about 10–1000 ppm (parts per million), of the metal portion of the initiator, preferably 10–200 ppm, based on the amount of dry coal.

The preferred beneficiation process further requires the use of a fluid organic medium to facilitate contact of the surface of the coal particles with the polymerization reaction medium. Fluid organic media included within the scope of this invention are, for example, fuel oil, such as No. 2 or No. 6 fuel oils, other hydrocarbons including benzene, toluene, xylene, hydrocarbon fractions such as naphtha and medium boiling petroleum fractions (boiling point 100°–180° C.), dimethylformamide, tetrahydrofuran, tetrahydrofurfuryl alcohol, dimethylsulfoxide, methanol, ethanol, isopropyl alcohol, acetone, methylethylketone, ethylacetate, and the like, and mixtures thereof. For the purpose of this invention, fuel oil is a preferred fluid organic medium. The amounts of fluid organic medium employed can vary widely and, in general, will be used at a level of from about 0.01% to about 5%, and preferably from about 0.1% to about 2%, by weight of the coal undergoing cleaning. The process contemplates conventional froth recovery techniques, intermittent or continuous skimming of the surface-treated coal froth from the surface of the slurry being an entirely suitable technique. The recovered coal froth (flocculate), can if desired, be subjected to one or more further cycles of chemical surface treatment and/or frothing as described herein to effect greater separation of impurities and/or recovery of treated pulverized coal.

A particularly effective technique for separating the treated coal particles from unwanted ash and sulfur in the water phase is an aeration spray technique wherein a coal froth phase is formed by spraying or injecting the treated coal-water slurry into the surface of cleaning water as is described and claimed in U.S. Pat. Nos. 4,347,127, 4,347,126 and copending U.S. application Ser. No. 495,621 filed May 18, 1983 all incorporated herein by reference. Briefly, according to the method and apparatus described in these patents and application, the coal slurry is injected through at least one spray nozzle at pressures, for example, at from about 15–20 psi at a spaced-apart distance above the water surface into the water surface producing aeration and a frothing or foaming of the coal particles, causing these particles to float to the water surface for skimming off.

It is also contemplated herein that the coal froth phase which results from the initial surface treating step, as hereinbefore described, may be further washed and/or surface treated by admixing the same with a further aqueous medium which can comprise simply clean water or water and water conditioning agents or water and any or all of the ingredients which comprise the initial surface treating admixture. Moreover, any number of these additional washing and/or surface treatments may be utilized for the purposes of this invention before recovering the beneficiated coal product. Furthermore, it is within the scope of this invention to similarly process the aqueous phases which are concomitantly formed along with the coal froth phases produced in accordance with the process of the invention. Thus, these aqueous phases may be surface treated and/or washed as hereinbefore described and the residual beneficiated coal may be recovered for increased yields.

In order that those skilled in the art may better understand how the present invention is practiced, the following examples are presented by way of illustration and not by way of limitation.

EXAMPLE 1

500.0 gm samples of a pond refuse coal (A, B & C) received from the Electro-Met Coal Company, Inc. were scrubbed at 55 to 57% solids in water in a laboratory attrition scrubber, (made by the Denver Equipment Company) operated at 2400 r.p.m. for about two minutes. The coal samples were then screened on 100 mesh and the fines deslimed with a laboratory 30 mm diameter hydrocyclone. The first overflow (slime product) from the hydrocyclone was rerun through the hydrocyclone, then the underflow products combined and rerun to make a final underflow product which was combined with the plus 100 mesh and beneficiated. The above samples were minus 16 mesh. There was some material which was plus 16 mesh. This was ground with a mortar and pestle until it passed 16 mesh. All beneficiation was carried out in accordance with the procedures of U.S. Pat. No. 4,304,573 using the following reagents:

| | lbs/ton |
|---|---|
| Tall oil | 0.5 |
| No. 2 fuel oil | 5.0 |
| $Cu(NO_3)_2.3\ H_2O$ | 1.0 |
| $H_2O_2$ | 1.0 |
| 2-ethylhexanol | 0.82 |

Since 16 mesh is too coarse for preferred coal-aqueous mixtures, another group of coal samples from each pond (A, B and C) were scrubbed, deslimed, ground 80% minus 200 mesh and then beneficiated. For comparative purposes, samples of the coal were not scrubbed and/or deslimed and then beneficiated.

Table 1 is a summary of all the test runs. The data show that beneficiation of the as-received refuse results in very low coal recovery (37.0%). While grinding without desliming improves coal recovery markedly (no doubt because fresh, clean particle surfaces are produced), grinding is an expensive process. Scrubbing and desliming (according to the present invention) is a much more efficient and less costly means of producing these new particle surfaces than is grinding.

EXAMPLE 2

A six kilogram sample of tailing pond coal refuse submitted by Old Ben Coal Company, Mine No. 1 was dried in a coal drying oven at 104° F. for about 24 hours. The coal was then stage crushed all minus 28 mesh.

500 gm samples of the coal, so dried and crushed, were scrubbed at high solids (about 57%) in water in a laboratory attrition scrubber (Denver Equipment Company) at 2400 r.p.m. After screening, the coal was deslimed either by decantation or with a laboratory 30 mm diameter hydrocyclone. In the case of hydrocycloning, after screening out the +100 mesh material, the remaining sample was passed through the hydrocyclone at approximately 5% solids. The overflow from this run was passed through again and the underflow from both the first and second separations were combined and also rerun. The overflows from both passes were combined. The underflow was recombined with the +100 mesh material. All the samples were beneficiated using the process as described in U.S. Pat. No. 4,304,573. The reagents used were as follows:

| | lbs./ton |
|---|---|
| Tall oil | 0.5 |
| No. 2 fuel oil | (amount shown in TABLE 2) |
| $Cu(NO_3)_2.3\ H_2O$ | 1.0 |
| $H_2O_2$ | 1.0 |
| 2-ethylhexanol | 0.82 |

During the scrubbing, 10 lbs./ton of Marasperse dispersant(lignin-sulfonate), available from American Can Co., dispersant was used. For comparative purposes, samples were beneficiated, as received, or just ground or deslimed only, prior to beneficiation. The test results are summarized in Table 2 below.

TABLE 1

| Pond | Example No. | Cake % Moisture | % Ash Feed | % Ash Product | % Sulfur Feed | % Sulfur Product | % Volatiles Feed | % Volatiles Product | % Fixed Carbon Feed | % Fixed Carbon Product | % Coal Recovery |
|---|---|---|---|---|---|---|---|---|---|---|---|
| 16 Mesh Feed Not Scrubbed Or Deslimed Prior To Beneficiation | | | | | | | | | | | |
| A | 1 | 26.3 | 17.9 | 6.0 | 0.86 | 0.75 | — | — | — | — | 37.0 |
| 16 Mesh Feed Scrubbed and Deslimed Prior To Beneficiation | | | | | | | | | | | |
| A | 2 | 10.0 | 19.8 | 6.1 | 0.74 | 0.73 | 30.2 | 32.4 | 50.1 | 61.5 | 86.1 |
| B | 3 | 12.7 | 21.3 | 4.7 | 1.39 | 0.90 | 31.4 | 35.5 | 46.9 | 59.8 | 76.4 |
| C | 4 | 10.8 | 16.3 | 5.0 | 1.09 | 1.09 | 33.4 | 36.5 | 50.1 | 58.5 | 89.3 |
| Scrubbed and Deslimed As Above and Ground 80%-200 Mesh Prior To Beneficiation | | | | | | | | | | | |
| A | 5 | 26.8 | 20.2 | 5.3 | 0.76 | 0.73 | 30.0 | 33.2 | 49.8 | 61.5 | 83.0 |
| B | 6 | 26.4 | 22.5 | 4.5 | 0.86 | 0.92 | 31.1 | 36.2 | 46.4 | 59.3 | 72.7 |
| C | 7 | 25.4 | 16.4 | 4.5 | 1.12 | 1.10 | 33.2 | 36.7 | 50.2 | 58.8 | 87.9 |
| Ground 80%-200 Mesh Then Deslimed Prior To Beneficiation | | | | | | | | | | | |
| A | 8 | 19.8 | 20.7 | 5.6 | 0.78 | 0.75 | 34.2 | 38.4 | 45.1 | 56.1 | 60.8 |
| Ground 80%-200 Mesh And Not Deslimed Prior To Beneficiation | | | | | | | | | | | |
| A | 9 | 18.8 | 20.4 | 5.0 | 0.86 | 0.77 | 30.2 | 33.5 | 49.4 | 61.5 | 71.6 |
| B | 10 | 25.0 | 22.0 | 4.4 | 1.36 | 0.93 | 31.1 | 35.9 | 46.9 | 59.7 | 54.2 |
| C | 11 | 18.7 | 17.1 | 3.8 | 1.51 | 1.02 | 33.2 | 36.5 | 49.6 | 59.7 | 79.5 |

TABLE 2

| Example | lbs/ton fuel oil | Pre-Treatment | % Ash Feed | % Ash Prod. | % Sulfur Feed | % Sulfur Prod. | % Volatiles Feed | % Volatiles Prod. | Fixed Carbon Feed | Fixed Carbon Prod. | % Coal Recovery |
|---|---|---|---|---|---|---|---|---|---|---|---|
| 12 | 20 | none, i.e. not ground not scrubbed not deslimed | 18.8 | 6.0 | 2.52 | 2.41 | 37.1 | 41.2 | 44.1 | 52.8 | 47.0 |
| 13 | 20 | ground only | 18.9 | 6.9 | 2.33 | 2.37 | 34.9 | 37.7 | 46.3 | 55.4 | 71.6 |
| 14 | 10 | deslimed only | 18.2 | 8.8 | 2.33 | 2.33 | 34.7 | 38.4 | 47.1 | 52.8 | 48.5 |
| 15 | 5 | scrubbed and deslimed | 18.7 | 8.2 | 2.29 | 2.31 | 34.6 | 39.1 | 46.7 | 52.7 | 65.6 |

TABLE 2-continued

| Example | lbs/ton fuel oil | Pre-Treatment | % Ash | | % Sulfur | | % Volatiles | | Fixed Carbon | | % Coal Recovery |
|---|---|---|---|---|---|---|---|---|---|---|---|
| | | | Feed | Prod. | Feed | Prod. | Feed | Prod. | Feed | Prod. | |
| 16 | 5 | scrubbed and deslimed by hydro cycloning | 17.8 | 8.0 | 2.27 | 2.31 | 33.2 | 36.2 | 49.0 | 55.8 | 85.0 |

Obviously, other modifications and variations of the present invention are possible in light of the above teachings. It is therefore to be understood that changes may be made in particular embodiments of this invention which are within the full intended scope of the invention as defined by the appended claims.

What is claimed is:

1. A process for modifying the surfaces of oxidized coal and beneficiating said coal, said process comprising the steps of:

(i) subjecting coal having oxidized surfaces to high shear agitation in water;

(ii) desliming the coal mixture resulting from step (i); and (iii) introducing the deslimed coal mixture resulting from step (ii) to froth flotation beneficiation, said froth flotation beneficiation comprising admixing said deslimed coal mixture with a surface treating mixture comprised of a polymerizable monomer, a catalyst and a liquid organic carrier.

2. The process according to claim 1 wherein said polymerizable monomer is tall oil, said catalyst comprises cupric nitrate and said liquid organic carrier is fuel oil.

3. The process according to claim 1 wherein said desliming is carried out in a hydrocyclone.

* * * * *

UNITED STATES PATENT AND TRADEMARK OFFICE

CERTIFICATE OF CORRECTION

PATENT NO. : 4,605,420

DATED : August 12, 1986

INVENTOR(S) : McGarry et al.

It is certified that error appears in the above-identified patent and that said Letters Patent are hereby corrected as shown below:

At Column 3, Line 41, "hioh" should read --high--;

In the heading of Table 2 bridging columns 7 and 8, "Fixed Carbon" should read --% Fixed Carbon--;

In the heading of Table 2-continued bridging columns 9 and 10, "Fixed Carbon" should read --% Fixed Carbon--;

At Column 9 in Table 2-continued, "hydro cycloning" should read --hydrocycloning--.

Signed and Sealed this

Twenty-eighth Day of October, 1986

[SEAL]

*Attest:*

DONALD J. QUIGG

*Attesting Officer*

*Commissioner of Patents and Trademarks*